US006054980A

United States Patent [19]

Eglit

[11] Patent Number: 6,054,980

[45] Date of Patent: Apr. 25, 2000

[54] DISPLAY UNIT DISPLAYING IMAGES AT A REFRESH RATE LESS THAN THE RATE AT WHICH THE IMAGES ARE ENCODED IN A RECEIVED DISPLAY SIGNAL

[75] Inventor: Alexander Julian Eglit, Half Moon Bay, Calif.

[73] Assignee: Genesis Microchip, Corp., Mountain View, Calif.

[21] Appl. No.: 09/227,284

[22] Filed: Jan. 6, 1999

[51] Int. Cl.[7] ..... G09G 5/00

[52] U.S. Cl. ..... 345/204; 345/202; 345/97; 348/441

[58] Field of Search ..... 345/204, 132, 345/202, 203, 97, 516; 348/441; 386/109

[56] References Cited

U.S. PATENT DOCUMENTS 5,321,419 6/1994 Katakura et al. .

5,371,518 12/1994 Hannah ..... 345/516

5,446,496 8/1995 Foster et al. ..... 348/441

*Primary Examiner*—Steven J. Saras

*Assistant Examiner*—Fritz Alphonse

*Attorney, Agent, or Firm*—Law Firm of Naren Thappeta

[57] ABSTRACT

A display unit receiving a display signal having source image frames encoded at an encoding rate ($FR_S$). A display screen may be refreshed at a refresh rate which is less than the encoding rate. An actual refresh rate ($FR_D$) is determined such that $FR_S/FR_D=(N+1)/N$. To satisfy this equation, the actual refresh rate ($FR_D$) may be selected to be slightly different from the target refresh rate supported by the display screen. Pixel data elements representing source image frames (received at $FR_S$) may be written into a frame buffer, and the pixel data elements may be retrieved at a frequency determined by refresh rate $FR_D$. However, at least a part of every $(N+1)^{st}$ source image frame is not written into the frame buffer to avoid image tearing problems.

23 Claims, 4 Drawing Sheets

DISPLAY UNIT DISPLAYING IMAGES AT A REFRESH RATE LESS THAN THE RATE AT WHICH THE IMAGES ARE ENCODED IN A RECEIVED DISPLAY SIGNAL

BACKGROUND OF THE INVENTION

1. Field of the Invention

The present invention relates to display units for use in computer systems, and more specifically to a method and apparatus for displaying images at a refresh rate less than the rate at which the images are encoded in a received display signal.

2. Related Art

Display units are often used in computer systems for displaying images. A typical display unit receives a display signal comprising display data and synchronization signals. The display data contains image frames and the synchronization signals indicate the separation of the image frames and the lines within each image frame. A display unit displays the encoded images.

Image frames are often encoded at a rate, which may be referred to as encoding rate. That is, encoding rate specifies the number of image frames received in a given duration, for example a second. As an illustration, under the PC-98 specification by Microsoft Corporation, analog display signals may contain image frames encoded at 75 Hz encoding rate.

Display units often contain a display screen, and the display screen is refreshed with images encoded in a received display signal. The rate at which the images are refreshed may be referred to as a refresh rate. A target refresh rate is generally associated with each display unit. The target refresh rate is usually specified by the manufacturer, and determined by the implementation of the display screen and associated interfaces. The target refresh rate is often limited to minimize the overall cost of implementation of a display unit. For example, flat monitors are often implemented for 60 Hz target refresh rate.

The target refresh rate is some times less than the encoding rate. Under such circumstances, a display unit may need to convert the image frame rate from the encoding rate to the target refresh rate, and the process may be referred to as frame rate conversion. Display units typically employ frame buffers for frame rate conversion.

Typical frame rate conversions entail generating pixel data elements representing image frames encoded in a received display signal, and retrieving the pixel data elements at a different frame rate. In this context, the image frames encoded in a display signal may be referred to as source image frames and the image frames displayed may be referred to as displayed image frames.

In a known prior scheme, a television display unit may employ a frame buffer having sufficient memory capacity to store data representing a single source image frame and convert the frame rate by a factor of 1/Z (wherein Z is an integer). Typically, only one of every Z source image frames is displayed and the remaining (Z−1) source image frames may be ignored.

However, such an approach may not be suited in digital display units which typically require frame rate conversions by a factor not equal to an integer. In the examples noted above, the frame rate may need to be converted from 75 Hz (PC-98 Standard) to around 60 Hz. In addition, it may be a requirement that the same display unit operate with different encoding rates (e.g., 75 Hz, 72 Hz, and 90 Hz), which also may not be practicable with this approach.

An alternative embodiment may employ a frame buffer with memory space to store one image frame, and attempt to retrieve pixel data elements at a desired refresh frame rate. However, using such limited amount of memory space may lead to image tearing. In general, image tearing refers to display artifacts which may be generated if one portion of a displayed image is generated from one source image frame, and the other portion is generated from another source image frame. A displayed image may be generated from two source images as the data corresponding to a subsequent encoded image frame replaces the data corresponding an earlier source image frame before the displayed image (or image to be displayed) is completely generated.

At least to overcome the image tearing problem, a display unit may employ a larger frame buffer for frame rate conversion. For example, a frame buffer having sufficient storage for two source image frames may be used. The display unit may ensure that a source image frame is not partially retrieved for use in a display by using the other stored frame. Accordingly, the image tear problem may be avoided.

However, one problem with such a solution is it may not be feasible to cost-effectively integrate such large frame buffers into a single integrated circuit along with other components generating display signals for a display screen. Integration may be important in digital display units, for example, to minimize the manufacturing costs and the amount of space used.

Accordingly, what is needed is a flexible approach which enables a display unit to display images at a refresh rate which is lower than the encoding rate used in a received display signal. The images may need to be displayed without artifacts such as image tears while not requiring substantial memory space in frame buffers. In addition, the display unit may need to operate with several encoding rates.

SUMMARY OF THE INVENTION

A display unit may receive a display signal with the source image frames being encoded at an encoding rate $FR_S$. The encoding rate may be greater than a target refresh rate specified for the display unit. The present invention provides for frame rate conversion without requiring excessive memory space in a frame buffer, while avoiding the image tearing problem noted above.

A display unit may contain a data recovery block for generating pixel data elements representing each source image. The data recovery block may correspond to an analog to digital converter (ADC) when an analog display signal is received and to a digital receiver when a digital display signal is received. A frame buffer may be provided for storing the pixel data elements. In an embodiment, memory space for storing only one source image is provided in the frame buffer.

A control circuit computes a number N and an actual refresh rate $FR_D$, while satisfying the equation, $FR_S/FR_D=(N+1)/N$. In many cases $FR_D$ equals a target refresh rate specified for the display unit. However, in some situations, $FR_D$ may be chosen to be approximately equal to the target refresh rate to facilitate the availability of N. For example, if the target refresh rate is 60 Hz and the encoding rate is 85 Hz, the $FR_D$ may be set to 56.67 Hz such that N is set to 2.

Once N is determined, at least some pixel data corresponding to every $(N+1)^{st}$ source image frame may be disabled from being stored into the frame buffer. As a result, the image tearing problem may be avoided while using a frame buffer having sufficient memory space to store only one source image frame.

Thus, the present invention enables the image tearing problem to be avoided by ensuring that the encoding rate ($FR_S$) and actual refresh rate ($FR_D$) have a ratio of (N+1)/N and by disabling the storing of pixel data elements related to every $(N+1)^{st}$ source image frame.

The present invention enables cost-effective implementation of digital display units as frame buffers with limited memory space can be used.

The present invention enables a display unit to operate in conjunction with different encoding rates as the actual refresh rate may be varied slightly from the target refresh rate.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein.

DETAILED DESCRIPTION OF THE PREFERRED EMBODIMENTS

1. Overview and Discussion of the Invention

The present invention enables a display unit to achieve frame rate conversion without requiring excessive memory space, while avoiding the image tear problem noted above. In accordance with the present invention an integer N is determined, which satisfies the following relationship:

$$FR_S/FR_D=(N+1)/N \qquad \text{Equation (1)}$$

Wherein $FR_S$ and $FR_D$ respectively represent the encoding rate and the actual refresh rate for refreshing a display screen. As described below, the actual refresh rate may be chosen to be slightly different from a target refresh rate supported by a display screen to ensure the availability of integer N.

Only N of every N+1 source image frames are then used for generating display signals, that is, for refreshing a display screen. The $(N+1)^{st}$ source image frame may be ignored. The invention is described below in further detail with reference to several example embodiments. It is helpful to first understand an example environment in which the present invention can be implemented.

2. Example Environment

In general, the present invention can be implemented in any display unit of a computer system. However, the invention has particular application in digital display units. A computer system may be one of, without limitation, lap-top and desk-top personal computer systems, work-stations, special purpose computer systems, general purpose computer systems, network computers, and many others. The invention may be implemented in hardware, software, firmware, or combination of the like.

Figure 1:
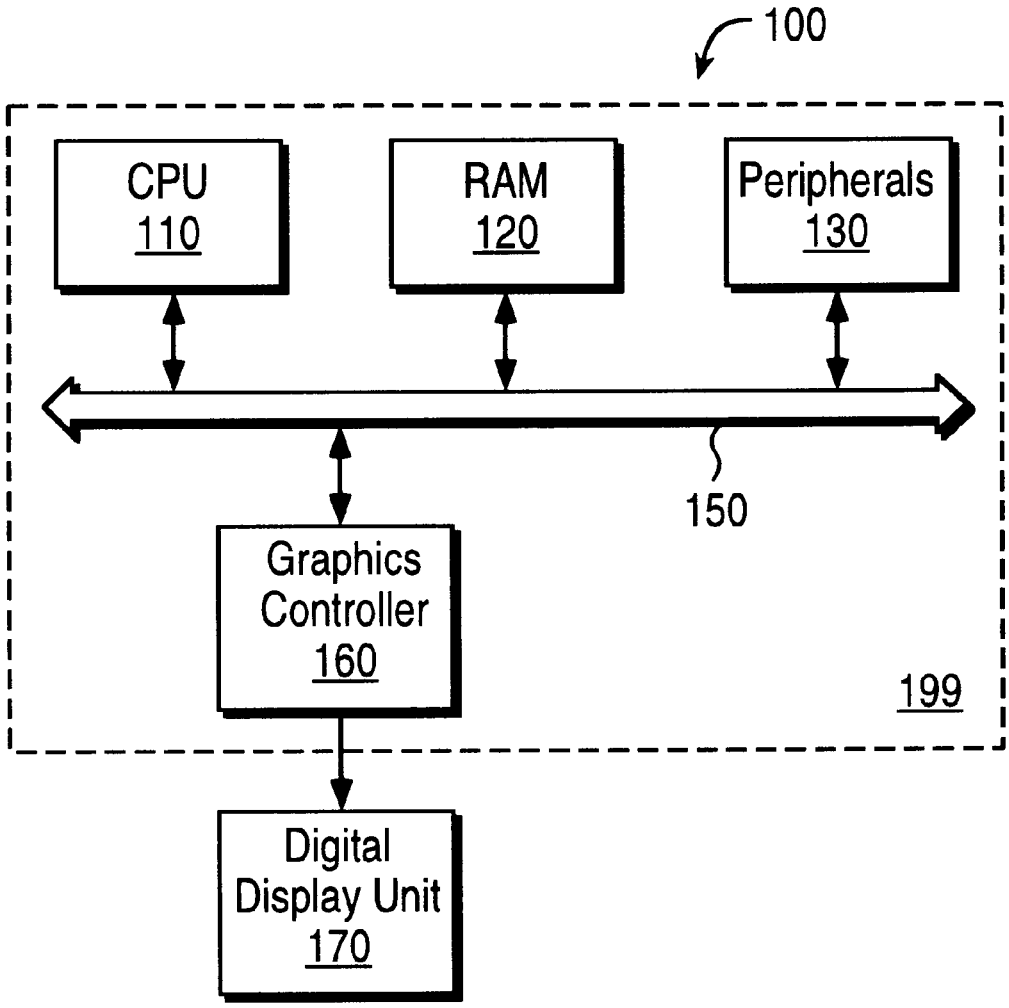
FIG. 1 is a block diagram of a computer system implemented in accordance with the present invention.

FIG. 1 is a block diagram of computer system 100 in which the present invention can be implemented. Computer system 100 includes central processing unit (CPU) 110, random access memory (RAW) 120, one or more peripherals 130, graphics controller 160, and display unit 170. CPU 110, RAM 120 and graphics controller 160 are typically packaged in a single unit, and such a unit is referred to as graphics source 199 as an analog display signal is generated by the unit. All the components in graphics source 199 of computer system 100 communicate over bus 150, which can in reality include several physical buses connected by appropriate interfaces.

RAM 120 stores data representing commands and possibly pixel data elements representing a source image. CPU 110 executes commands stored in RAM 120, and causes different commands and pixel data to be transferred to graphics controller 160. Peripherals 130 can include storage components such as hard-drives or removable drives (e.g., floppy-drives). Peripherals 130 can be used to store commands and/or data which enable computer system 100 to operate in accordance with the present invention. By executing the stored commands, CPU 110 provides the electrical and control signals to coordinate and control the operation of various components.

Graphics controller 160 receives data/commands from CPU 110, generates display signals including display data and corresponding synchronization signals, and provides both to digital display unit 170. Ts display signals may be of analog form or digital form. When the display signals are of analog form, graphics controller 160 contains a digital to analog converter (DAC) for generating the analog display signals from pixel data elements. Analog display signals may be generated in modes such as EGA, VGA and SVGA modes as is well knowvn in the relevant arts.

When the display signal is of digital form, graphics controller 160 may contain a digital transmitter (e.g. panel link product from Silicon Image, Inc., 10131 Bubb Road, Cupertino, Calif. 95014, Phone: (408) 873-3111). The digital transmitter generates digital display signal, for example, according to the Plug and Display VESA standards for flat-panel monitors. Some of the graphics modes and standards are described in detail in a book entitled, "Programmer's Guide to the EGA, VGA, and Super VGA Cards", published by Addition-Wesley Publishing Company, by Richard F. Ferraro, ISBN Number 0-201-62490-7, which is incorporated in its entirety herewith.

In the case of analog display signals, the display signal is in the form of RGB signals and the reference clock signal includes the VSYNC and HSYNC signals well known in the relevant arts. Therefore, three analog display signals (red, green and blue) are generated from each pixel data element. For conciseness, the present invention is described with reference to one display data signal. It should be understood that the description may be applicable to all the three display data signals.

In general, graphics controller 160 first generates pixel data elements of a source image with a predefined width and height (measured in terms of number of pixel data elements). The pixel data elements for a source image may either be provided by CPU 110 or be generated by graphics controller 160 in response to commands from CPU 110. Graphics controller 160 typically includes a digital to analog converter (DAC) for generating an analog display signal based on the pixel data elements in a known way. The source images are encoded at an encoding rate in the display signal.

Digital display unit 170 receives a display signal from graphics controller 160, and displays the images encoded in the display signal. In general, display unit 170 recovers pixel data elements representing a source image and refreshes a display screen (contained within display unit 170) based on the recovered pixel data elements. It is generally desirable that the display screen be refreshed at the target refresh rate associated with the digital display unit 170. When the target refresh rate needs to be lower than the encoding rate, digital display unit 170 minimizes the amount of buffer space required in a frame buffer in accordance with the present invention as described below in further detail.

3. Method

Figure 2:
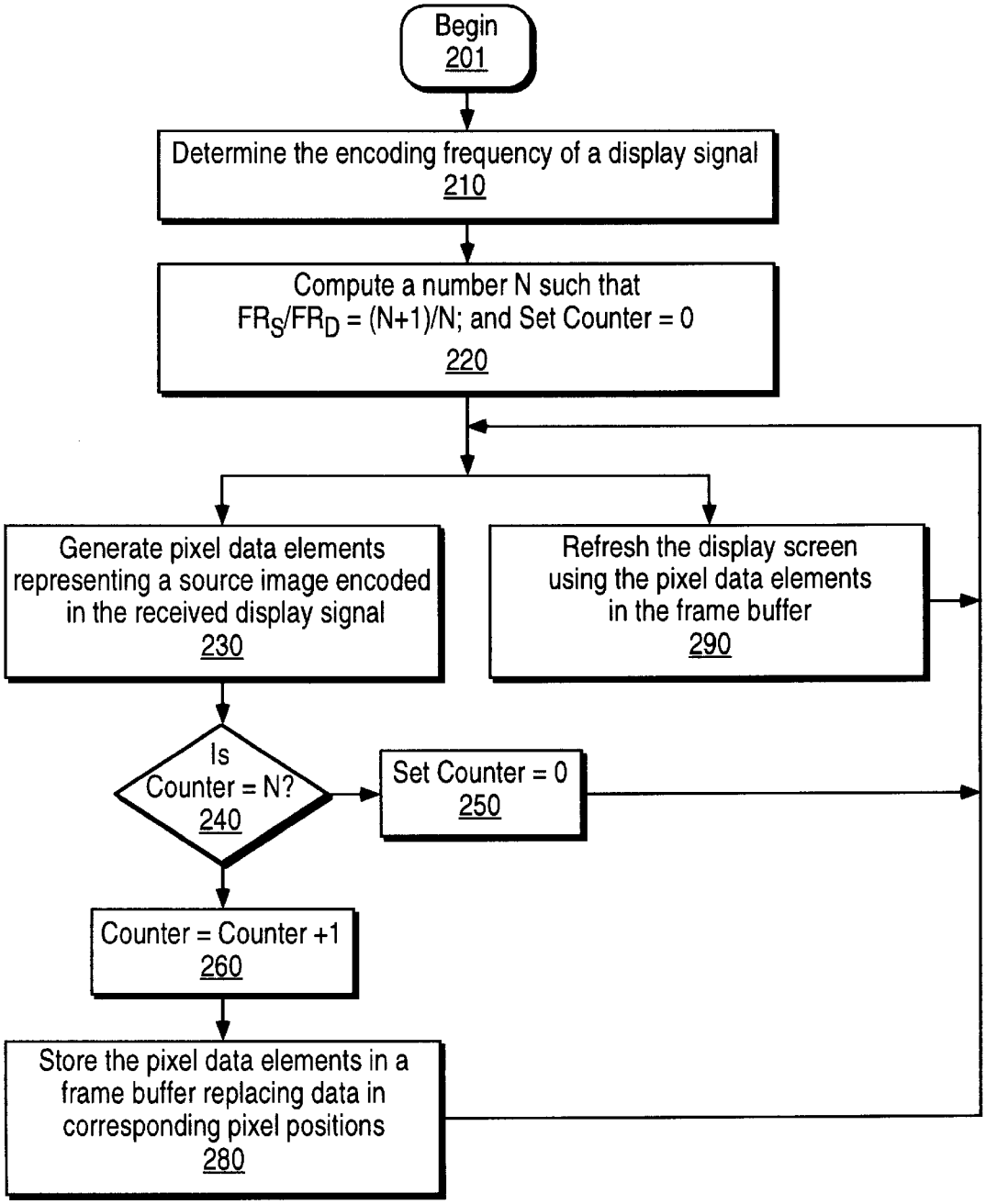
FIG. 2 is a flow-chart illustrating a method according to the present invention.

FIG. 2 is a flow-chart illustrating a method in accordance with the present invention. The flow-chart is described with reference to FIG. 1 for clarity. In step 210, digital display unit 170 may receive a display signal, with source images encoded at an encoding rate. The reception generally needs to be implemented consistent with the manner in which the display signal is generated in graphics source 199.

In step 220, a counter is set to zero, and an integer N is computed such that $FR_S/FR_D=(N+1)/N$, wherein $FR_S$ and $FR_D$ respectively represent the encoding rate and the actual refresh rate used for generating display signals on a display screen, as noted above with reference to Equation (1). It should be noted that for most practical applications N may be readily available for the target refresh rate supported by a digital display screen. In that case $FR_D$ equals the target refresh rate.

However, when N is not available for the target refresh rate, the actual refresh rate may be sightly different from the target refresh rate. Both the cases are illustrated with reference to an LCD panel having a target refresh rate of 60 Hz. The LCD panel may be tolerant to refresh rates lower than 60 Hz. In general, it is preferable to choose the actual refresh rate to be lower than the target refresh to ensure that the hardware specifications are not violated.

Thus, when a digital display screen having a target refresh rate of 60 Hz is used, the value of N is 10 for encoding rate of 66 Hz, is 6 for an encoding rate of 70 Hz, is 5 for an encoding rate of 72 Hz, is 4 for an encoding rate of 75 Hz, and 2 for an encoding rate of 90 Hz. When the encoding rate equals one of these parameters, the actual refresh rate may equal the target refresh rate (60 Hz) of the digital display screen.

However, some times N (integer) may not be available if the actual refresh rate is to equal the target refresh rate. For example, if the encoding rate equals 85 Hz, the actual refresh rate may be chosen to be 56.67 Hz such that N=2. Similarly, of the encoding rate equals 87 Hz, the actual refresh rate may be chosen to be 58 Hz such that N=2.

The above noted numbers represent the most widely used encoding rates in the market place. Similarly, 60 Hz represents the target refresh rate specified by several low-cost LCD panel monitors. As described below, the computation of N enables frame rate conversion to be performed by using a frame buffer having memory capacity to store data representing only a single source image frame.

Continuing with reference to FIG. 2, in step 230, pixel data elements representing a source image encoded in display signal may be generated. In common applications, the pixel data elements used at graphics controller 160 to generate the display signals are recovered. The recovery process depends on whether the received signal is of the analog form or digital form. The recovery may be performed in a known way.

In step 240, the value in the counter is examined to determine if it is equal to N. If counter is not equal to N, control is passed to step 260, in which case the counter is incremented by 1 in step 260. Control then passes to step 280. In step 280, the pixel data elements may be stored in a frame buffer. In general, the pixel data elements generated in a present iteration may replace the pixel data elements of the same positions in the prior iteration. If the value of the counter is determined to be equal to N in step 240, the counter is set to zero and control passes to step 290.

In step 290, the display screen is refreshed with the pixel data elements presently available in the frame buffer. Typically, pixel data related to the positions to be refreshed next is retrieved and display signals are generated based on the retrieved data. The display screen may be refreshed at $FR_D$ as computed above.

It should be noted that step 290 is performed in parallel with steps 230 and 280. Without the operation of the present invention, part of a presently displayed source image frame in the frame buffer may be replaced by a newly generated source image as the refresh rate is slower than the encoding rate, and the image tearing problem may occur in the image displays. The image tearing problem may be eliminated by the operation of the present invention.

However, as the storing of the frame is bypassed once every N+1 ames in step 280, such replacement may be avoided in the middle of the retrieval of pixel data elements representing a source image frame. The theoretical foundation for such avoidance is briefly noted below first Example embodiments implementing the method of FIG. 2 are then described.

4. Theoretical Basis

To avoid image tearing, the pixel data elements retrieved from a frame buffer for an image to be displayed should not be related to more than one image frame. As the write occurs at a faster rate than read, for an existing frame not to be overwritten before being completely retrieved, the following condition may need to be satisfied:

$$X>=X_{Min}=T_D-T_S \qquad \text{Equation (2)}$$

wherein X represents the time interval between the beginning of reading of an existing frame in the frame buffer and the beginning of writing of a subsequent frame into the frame buffer, $X_{Min}$ is minimum required time duration for an overwrite not to occur, $T_D$ represents the time period for retrieving a stored image frame according to the actual refresh rate, and $T_s$ represents the time period for storing an image frame according to the encoding rate.

The delay between the beginning of writing of a source image frame and the beginning of the reading of the next display image frame can be calculated as follows:

$$(M)=M*Ts \bmod Td \qquad \text{Equation (3)}$$

wherein M is an integer 1 to N, assuming that the overwriting phenomenon repeats every N cycles.

To avoid the image tear, the following equation may be derived from Equations (2) and (3):

$$M*Ts \bmod Td>=Td-Ts \qquad \text{Equation (4)}$$

$$\text{In addition, } Td=(FR_S/FR_D)*Ts \qquad \text{Equation (5)}$$

Substituting Equation (5) into (4), we have $$(M*Td*FR_D/FR_S)\bmod Td>=Td*(1-(FR_D/FR_S)) \qquad \text{Equation (6)}$$

Reducing both sides of Equation by Td (by assuming it to be 1), yields $$(M*FR_D/FR_S)\bmod 1>=1-FR_D/FR_S \quad \text{Equation (7)}$$

Substituting Equation (1) into Equation (7) yields:

$$(M*N/(N+1))\bmod 1>=1-(N/(N+1))=1/(N+1) \quad \text{Equation (8)}$$

In the above equations, mod designates the modulo operation. For modulo-1 (mod 1), the result is equivalent to the fractional portion of the value (with integer portion discarded). For instance, 5.37 mod 1=0.37; 0.45 mod 1=0.45. Clearly, when $FR_S/FR_D=(N+1)/N$, the condition of Equation (8) is satisfied, and image tearing may accordingly be avoided. Thus, $FR_D$ and $FR_S$ are chosen in the ratio of N to (N+1) in accordance with the present invention.

Thus, from the above description, it may be appreciated that several embodiments of display units can be implemented in accordance with the present invention. An example embodiment of display unit 170 is described below in further detail.

5. Digital Display Unit

Figure 3:
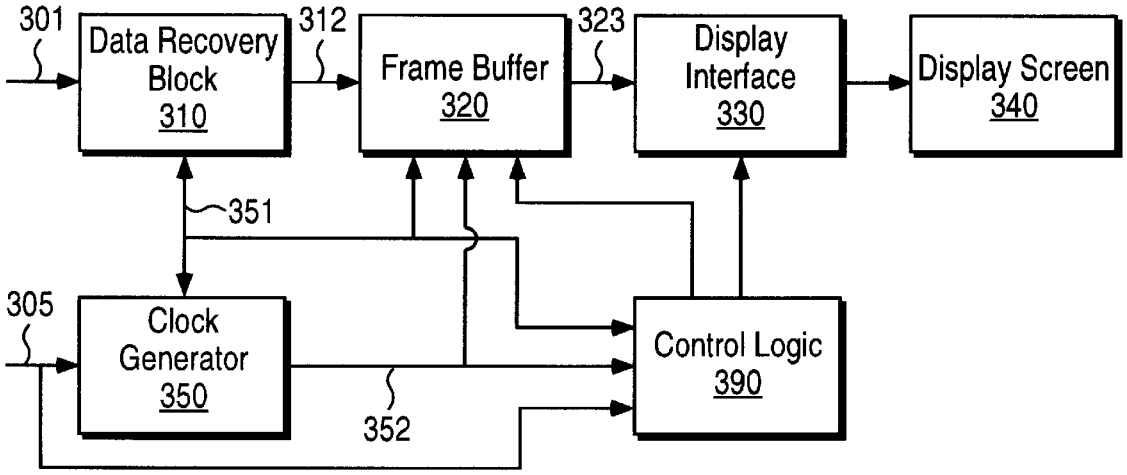
FIG. 3 is a block diagram of a display unit implemented in accordance with the present invention.

The details of an embodiment of digital display unit 170 are depicted in FIG. 3. Display unit 170 may include data recovery block 310, frame buffer 320, display interface 330, digital display screen 340, clock generator 350, and control logic 390. Each component is described below in further detail.

Clock generator 350 generates DCLK 352. Assuming for simplicity that the image is not resized (upscaled or downscaled), DCLK 352 may have a frequency ($F_{dlck}$) of:

$$F_{dclk} = F_{sclk} \times FR_D / FR_S \quad \text{Equation (11)}$$

$$= F_{sclk} \times T_S / T_D \quad \text{Equation (12)}$$

wherein $T_D$ represents the time period for retrieving a stored image frame according to the actual refresh rate, and $T_S$ represents the time period for storing an image frame according to the encoding rate. However, if the images need to resized, $F_{dclk}$ may have correspondingly faster or slower frequency depending on the particular design. Clock generator 350 may be implemented using one of several known ways.

DCLK 352 is often synchronized with synchronization signals associated with the received display signals. In the case of analog display signals, the synchronization signals may be received on separate signal lines (305). A sampling clock (SCLK) may also be provided to data recovery block 310 implemented in the form of an ADC. In general, SCLK has a frequency ($F_{sclk}$) corresponding to a source clock using which the received analog display signal is received The sampling clock may be generated, for example, as described in U.S. Pat. No. 5,796,392, entitled, "A Method and Apparatus for Clock Recovery in a Digital Display Unit", naming as inventor Alexander J. Eglit, and is incorporated in its entirety into the present application. In the case of digital display signals, data recovery block 310 may provide the synchronization signals.

Data recovery block 310 recovers the pixel data elements encoded in the received display signal. Data recovery block 310 may contain an analog-to-digital converter (ADC) when an analog display signal needs to be processed. When digital display signal needs to be processed, data recovery block 310 may be implemented as a digital receiver (e.g., Panel Link product from Silicon Image, Inc.).

The pixel data elements represent the source image frames encoded in the received display signal. The sampled pixel data elements are sent to frame buffer 320. Display interface 330 receives the stored data from frame buffer 320 and generates display signals for digital display screen 340. Digital display screen 340 may contain several pixels, which when collectively actuated causes an image frame to be displayed. Display interface 330 generally generates display signals compatible with the implementation of digital display screen 340. Digital display screen 340 and display interface 330 may be implemented in a known way.

Frame buffer 320 stores the pixel data elements to enable the frame rate conversion. The present invention enables the amount of storage space to be minimized. Frame buffer 320 may be implemented as either a dual-port memory permitting independent read and write accesses, or as a single port RAM with proper arbitration logic. In an embodiment, frame buffer is implemented as a RAM having storage capacity to store only one source image frame of data. Accordingly, frame buffer 320 may be implemented cost-effectively and potentially integrated with other components driving display screen 340 as a single integrated circuit.

Control logic 390 controls and coordinates the operation of the remaining components of FIG. 3. Control logic 390 may compute N consistent with Equation 1, and generate the control signals to frame buffer 320 to disable the writing of pixel data elements related to very $(N+1)^{st}$ frame. In an embodiment, N is computed as follows:

$$Td=(FR_S/FR_D)*Ts \quad \text{Equation (13)}$$

wherein $T_D$, $T_S$, $FR_S$, and $FR_D$ respectively represent the time period for retrieving a stored image frame according to the actual refresh rate, time period for storing an image frame according to the encoding rate, the encoding rate and the actual refresh rate.

$$\text{As } FR_S / FR_D = (N+1)/N,\ Td = Ts*(N+1)/N = Ts + Ts/N \quad \text{Equation (14)}$$

$$\text{Thus, } N = Ts/(Td - Ts) \quad \text{Equation (15)}$$

As N is defined to be a natural number, the result has to be rounded to the nearest integer:

$$N=ROUND(Ts/(Td-Ts)) \quad \text{Equation (16)}$$

By ensuring that $FR_S$ and $FR_D$ has a ratio of (N+1)/N and by disabling the $(N+1)^{st}$ frame, control logic 390 avoids the image tear while using small buffers for frame buffer 320. The manner in which control logic 390 may generate the related control signals and the manner in which frame buffer 320 may be implemented are described below with reference to example embodiments.

6. Control Logic

Figure 4:
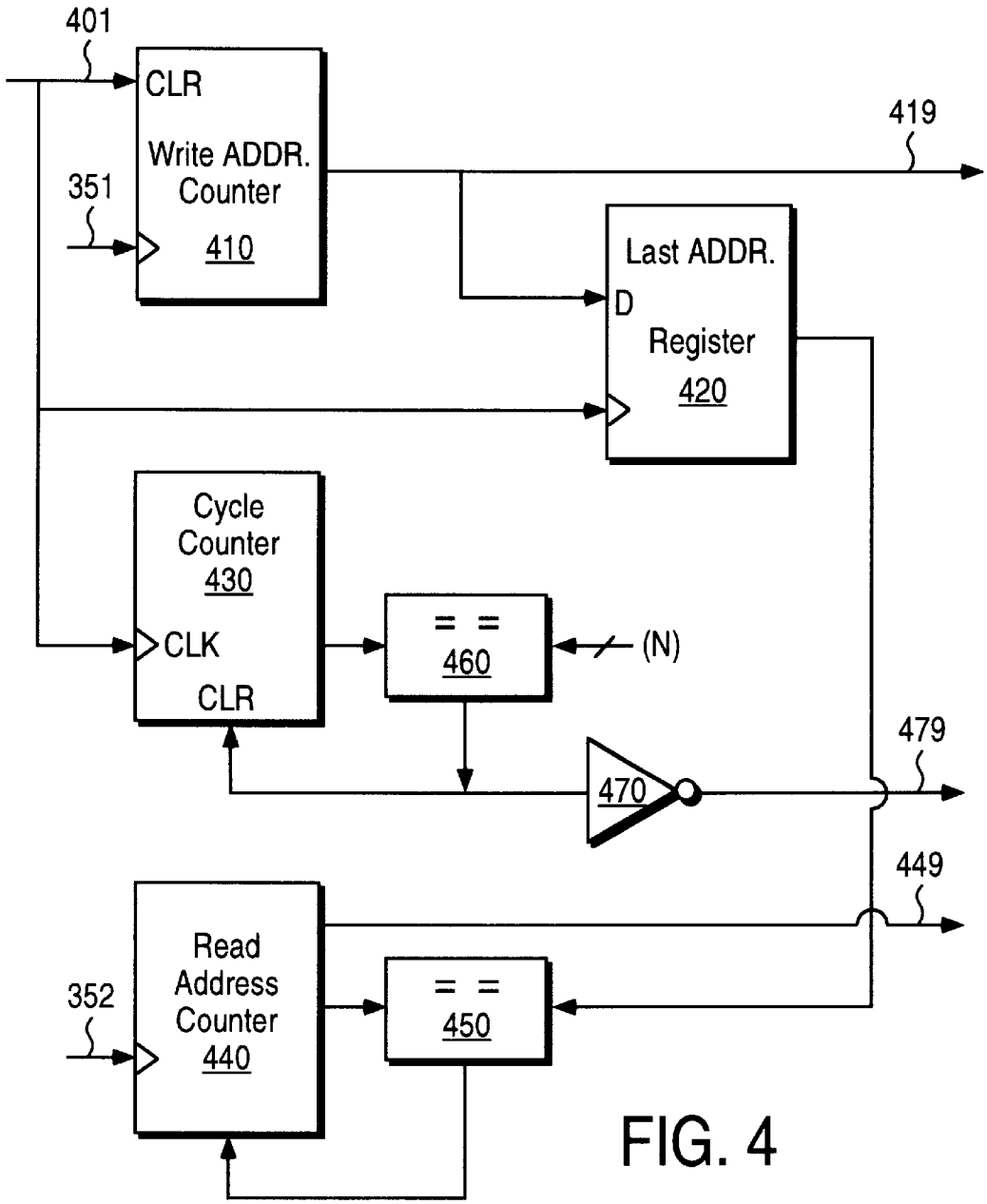
FIG. 4 is a block diagram of a control circuit which may provide the signals for enabling and disabling the storing of pixel data elements into a frame buffer in accordance with the present invention.

FIG. 4 is a block diagram illustrating the manner in which control logic 390 may generate relevant control signals, write address 419, write enable 479 and read address 449. Write address 419 identifies the address in frame buffer 320 at which a received pixel data element is to be written. Read address 449 identifies the address at which a pixel data element is to be retrieved. Write enable 479 is used to disable writing of pixel data elements related to every $(N+1)^{st}$ frame into frame buffer 320.

Write address counter 410 is increments an internally stored number according SCLK 351 rising edges, and accordingly counts the number of pixel data elements (or the write address in general) generated by data recovery block 310. Vertical synchronization pulses (VSYNC 401), separating source image frames in a received analog display signal, are provided on CLR input, and thus write address counter 410 is reset to zero every frame. The output (WA 419) of write address 410 is provided as an address to frame buffer 320. Similarly, read address counter 440 increments an internally stored number according to DCLK rising edges, and accordingly provides the read address on read address (RA) 449 bus.

Last address register 420 is clocked by VSYNC 401 and stores the last address generated by write address counter 410 for each source image frame. The last address is provided as an input to comparator 450, which compares the last address with the read address provided by read address counter 440. When the addresses are equal, a signal is generated on signal 454, which resets the read address counter 440 to zero.

Cycle counter 430 counts the number of source image frames as VSYNC 401 provides the clock signal. The output of cycle counter 430 is provided as an input to comparator 460, which compares the value N (of Equation 1) with the output. When the $(N+1)^{st}$ frame is being received, the two inputs have equal values and the output of comparator 460 is at a logical value of 1 during the entire frame. The high logical value resets cycle counter 430 to zero.

Inverter 470 provides a write-enable signal having a logical high value for the first N source image frames and a low value during the entire $(N+1)^{st}$ source image frame. Frame buffer 320 may ensure that the image tear does not occur using the signals generated by control circuit of FIG. 4. An example embodiment of frame buffer 320 is described below with reference to FIG. 5.

7. Frame Buffer

Figure 5:
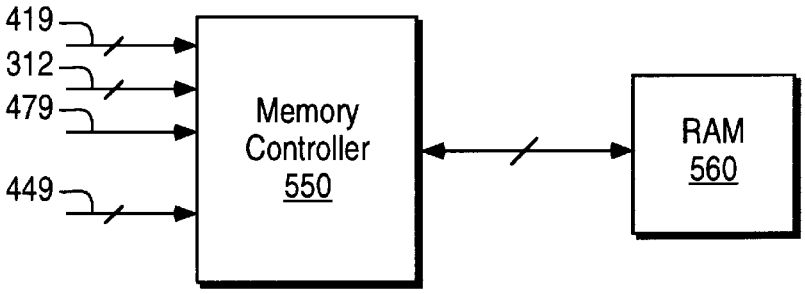
FIG. 5 is a block diagram of a frame buffer illustrating the manner in which the signals generated by the control circuit may be used in accordance with the present invention.

FIG. 5 is a block diagram illustrating the implementation of frame buffer 320 in one embodiment. Frame buffer 320 may contain memory controller 550 and random access memory (RAM) 560. In this embodiment, a single ported memory may be used for cost-effectiveness. One of several commercially available RAMs may be used for RAM 560. In the alternative, RAM 560, memory controller 550, data recovery block 310, clock generator 350 and control logic 390 may be integrated as a single integrated circuit driving display screen 340.

Memory controller 550 arbitrates between the read and write access requests to RAM 560. The pixel data elements representing source image frames may be received on bus 312. When a logical high value is received on write enable bus 479, the pixel data elements may be written into RAM 560 at the address specified by write address bus 419. The pixel data elements stored in RAM 560 are provided on bus 323 every clock cycle. The implementation of memory controller 550 and RAM 560 will be apparent to one skilled in the relevant arts based on the description provided herein.

Thus, using the embodiments of above, one may provide a display unit which refreshes display screens at a lower rate than the rate at which source image frames are encoded in an analog display signal. Even though the embodiments of above are described as generating display on digital display screen having a target refresh rate of around 60 Hz, the present invention can be used with digital display screens supporting different refresh rates. In general, the encoding rate needs to be greater than the target refresh rate, but less than or equal to twice the target refresh rate.

8. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of displaying images according to a plurality of source image frames encoded in a display signal, said source image frames being encoded at an encoding frequency $FR_S$ and said images being displayed on a display screen of a display unit, wherein said display unit has an associated target refresh rate, wherein said encoding frequency is greater than said target refresh rate, said method comprising the steps of:

(a) receiving said analog display signal in said display unit;

(b) determining an actual refresh rate $FR_D$ and N such that, $FR_S/FR_D=(N+1)/N$, wherein $FR_D$ is at least approximately equal to said target refresh rate and N in an integer greater than or equal to 2;

(c) generating a plurality of pixel data elements representing each of said source image frames;

(d) storing said plurality of pixel data elements in a frame buffer;

(e) retrieving said plurality of pixel data elements from said frame buffer such that said display screen can be refreshed at $FR_D$; and (f) disabling the storing of at least some of said plurality of pixel data elements related to every $(N+1)^{st}$ source image frame into said frame of step (d), wherein step (f) prevents image tearing problem by ensuring that a single display image is not generated from two source images.

2. The method of claim 1, wherein said frame buffer comprises sufficient memory space to store pixel data elements corresponding to one source image frame.

3. The method of claim 2, wherein said display unit comprises a digital display unit and said display signal comprises an analog display signal.

4. The method of claim 2, wherein step (f) comprises the step of disabling the storing of said pixel data elements related to every $(N+1)^{st}$ frame.

5. The method of claim 2, wherein said target refresh rate equals 60 Hz, said encoding rate equals 66 Hz, and said actual refresh rate is chosen to equal said target refresh rate such that N=10.

6. The method of claim 2, wherein said target refresh rate equals 60 Hz, said encoding rate equals 70 Hz, and said actual refresh rate is chosen to equal said target refresh rate such that N=6.

7. The method of claim 2, wherein said target refresh rate equals 60 Hz, said encoding rate equals 72 Hz, and said actual refresh rate is chosen to equal said target refresh rate such that N=5.

8. The method of claim 2, wherein said target refresh rate equals 60 Hz, said encoding rate equals 75 Hz, and said actual refresh rate is chosen to equal said target refresh rate such that N=4.

9. The method of claim 2, wherein said target refresh rate equals 60 Hz, said encoding rate equals 90 Hz, and said actual refresh rate is chosen to equal said target refresh rate such that N=2.

10. The method of claim 2, wherein said target refresh rate equals 60 Hz, said encoding rate equals 85 Hz, and said actual refresh rate is chosen to equal 56.67 Hz such that N=2.

11. The method of claim 2, wherein said target refresh rate equals 60 Hz, said encoding rate equals 87 Hz, and said actual refresh rate is chosen to equal 58 Hz such that N=2.

12. The method of claim 2, wherein said display signal comprises a digital display signal.

13. A display circuit for generating display signals on a display screen provided in a display unit, wherein a target refresh rate is associated with said display screen, said display circuit comprising:

a data recovery block for receiving a display signal containing a plurality of source image frames, wherein said source image frames are encoded at an encoding rate, said Data recovery block generating a plurality of pixel data elements representing each of said source image frames;

a frame buffer coupled to said data recovery block, said frame buffer for storing said plurality of pixel data elements;

a control circuit for determining an actual refresh rate $FR_D$ and an integer N such that, $FR_S/FR_D=(N+1)/N$, wherein $FR_D$ is at least approximately equal to said target refresh rate, said control circuit disabling the storing of at least some of said plurality of pixel data elements related to every $(N+1)^{st}$ source image frame;

a display interface for receiving said plurality of pixel data elements stored in said frame buffer and refreshing said display screen at said actual refresh rate, wherein disabling storing of every $(N+1)^{st}$ source image frame enables said display circuit to avoid image tearing on said display screen.

14. The display circuit of claim 13, wherein said frame buffer comprises a random access memory with a single port for read accesses and write accesses.

15. The display circuit of claim 13, wherein said frame buffer comprises sufficient memory space to store pixel data elements corresponding to one source image frame.

16. The display circuit of claim 13, wherein said control circuit comprises:

a cycle counter for counting the number of source image frames received in said display signal;

a comparator for comparing the output of said cycle counter with the value N and generating a reset signal for said cycle counter when an equality of detected, said reset signal resetting said cycle counter to zero, wherein the output of said comparator is provided as a write enable signal to said frame buffer, wherein pixel data elements are stored in said frame buffer when said write enable signal is at one logical level and storing is disabled when said write enable signal is in a second logical level.

17. The display circuit of claim 13, wherein said control circuit comprises:

a write address counter for generating a write address for storing each of said pixel data elements into said frame buffer, wherein said write address counter is clocked by a sampling clock provided to said Data recovery block also, said write address counter being reset to zero by a vertical synchronization signal;

a last address register coupled to the output of said write address counter, wherein said last address register stores the write address generated by said write address counter when said vertical synchronization signal is received;

a read address counter for generating a read address for retrieving pixel data elements from said frame buffer, wherein said retrieved data is provided to said display interface; and a comparator for comparing the address stored in said last address register with said address generated by said read address counter, said comparator resetting said read address counter to zero upon detecting an equality.

18. The display circuit of claim 13, wherein said display circuit is provided as an integrated circuit.

19. A digital display unit for displaying images represented by a plurality of source image frames, wherein said source image frames are encoded in a display signal at an encoding rate, said digital display unit comprising:

a display screen having a target refresh rate which is less than said encoding rate;

a data recovery block for receiving said display signal, said data recovery block generating a plurality of pixel data elements representing each of said source image frames;

a frame buffer coupled to said data recovery block, said frame buffer for storing said plurality of pixel data elements;

a control circuit for determining an actual refresh rate $FR_D$ and an integer N such that, $FR_S/FR_D=(N+1)/N$, wherein $FR_D$ is at least approximately equal to said target refresh rate, said control circuit disabling the storing of at least some of said plurality of pixel data elements related to every $(N+1)^{st}$ source image frame;

a display interface for receiving said plurality of pixel data elements stored in said frame buffer and refreshing said display screen at said actual refresh rate, wherein disabling storing of every $(N+1)^{st}$ source image frame enables said display circuit to avoid image tearing on said display screen.

20. The display unit of claim 19, wherein said display signal comprises an analog display signal and said data recovery block comprises an analog-to-digital converter (ADC).

21. The display unit of claim 19, wherein said frame buffer comprises sufficient memory capacity to store pixel data elements related to one source image frame.

22. A display unit for displaying images according to a plurality of source image frames encoded in a display signal, said display unit including a display screen designed to support a target refresh rate, said display unit comprising:

receiving means for receiving said display signal in said display unit;

means for determining an actual refresh rate $FR_D$ and an integer N such that, $FR_S/FR_D=(N+1)/N$, wherein $FR_D$ is at least approximately equal to said target refresh rate;

means for generating a plurality of pixel data elements representing each of said source image frames;

storage means for storing said plurality of pixel data elements in a frame buffer;

means for retrieving said plurality of pixel data elements from said frame buffer such that said display screen can be refreshed at $FR_D$; and means for disabling the storing of at least some of said plurality of pixel data elements related to every $(N+1)^{st}$ source image frame into said frame buffer, wherein said disabling prevents image tearing problem by ensuring that a single display image is not generated from two source images.

23. The display unit of claim 22, wherein said frame buffer comprises sufficient memory capacity to store pixel data elements related to one source image frame.

* * * * *